US005364387A

United States Patent [19]

Sweeney

[11] Patent Number: 5,364,387

[45] Date of Patent: Nov. 15, 1994

[54] DRUG ACCESS ASSEMBLY FOR VIALS AND AMPULES

[75] Inventor: Niall Sweeney, Rutherford, N.J.

[73] Assignee: Becton, Dickinson and Company, Franklin Lakes, N.J.

[21] Appl. No.: 101,126

[22] Filed: Aug. 2, 1993

[51] Int. Cl.[5] ..... A64M 1/00

[52] U.S. Cl. ..... 604/411; 604/403; 604/239

[58] Field of Search ..... 604/160, 166, 239–241, 604/272, 275, 403, 411, 414, 117, 407, 412, 413; 141/27, 329, 330

[56] References Cited

U.S. PATENT DOCUMENTS

| | | | |
|---|---|---|---|
| 1,263,793 | 4/1918 | Mulford | 604/411 |
| 1,274,081 | 7/1918 | Riethmueller | 604/117 |
| 2,512,568 | 6/1950 | Saffir | 604/239 |
| 2,590,895 | 4/1952 | Scarpellino | 604/272 |
| 2,911,123 | 11/1959 | Saccomanno | 604/411 |
| 3,076,457 | 2/1963 | Copen | 604/272 |
| 3,119,391 | 1/1964 | Harrison | 604/411 |
| 3,662,754 | 5/1972 | Halloran | 604/272 |
| 3,776,239 | 12/1973 | Cooley | 604/272 |
| 3,882,849 | 5/1975 | Jamshidi | 604/239 |
| 4,058,121 | 11/1977 | Choksi et al. | 604/411 |
| 4,505,709 | 3/1985 | Froning et al. | 604/411 |
| 4,990,140 | 2/1991 | Black | 604/239 |

*Primary Examiner*—John D. Yasko
*Assistant Examiner*—Anthony Gutowski
*Attorney, Agent, or Firm*—John L. Voellmicke

[57] ABSTRACT

A vial access pin includes opposed proximal and distal ends. The proximal end of the vial access pin is configured for mounting to a hypodermic syringe. The distal end of the vial access pin defines a cannula. The cannula includes a sharp point for piercing an elastomeric seal of a vial. A lumen extends through the cannula and communicates with the proximal end of the pin. A fluid flow aperture extends through the cannula at a location spaced from the distal end. The aperture enables a vial to be substantially drained without repositioning the cannula relative to the vial. An ampule access tube can be mounted over the cannula to cover the aperture and enable fluid in an ampule to be accessed.

22 Claims, 6 Drawing Sheets

DRUG ACCESS ASSEMBLY FOR VIALS AND AMPULES

FIELD OF THE INVENTION

The subject invention relates to a pin assembly that is mountable on a hypodermic syringe or other fluid delivery device, and that enables access to medication in either a glass ampule or in a vial having an elastomeric closure.

DESCRIPTION OF THE PRIOR ART

Liquid pharmaceuticals often are stored in rigid containers and are accessed by a hypodermic syringe. The typical prior art hypodermic syringe includes a syringe barrel with a mounting collar for threadedly engaging the hub of a needle cannula. The hub and the needle cannula are connected to one another or are maintained separately from the syringe barrel until shortly prior to use. In cases where the needle is maintained separately, the medical practitioner selects an appropriate prior art needle cannula for the procedure being carried out. The prior art needle cannula is removed from its sterile package, and the hub of the needle cannula is threadedly engaged with the mounting collar of the syringe barrel.

Some containers for liquid pharmaceuticals are plastic or glass vials with an elastomeric closure that can be penetrated by the needle of a hypodermic syringe. To access the liquid in a vial, the medical practitioner moves the plunger of the hypodermic syringe in a proximal direction to draw into the syringe barrel a volume of air substantially equal to the volume of medication that is desired. The open distal end of the needle is then urged through the elastomeric closure of the vial, and the air in the syringe barrel is injected into the vial. The distal tip of the needle and the vial engaged therewith are then pointed gravitationally upwardly. The practitioner ensures that the distal tip of the prior art needle is covered by the medication in the vial by manipulating the needle and the vial with respect to each other. The plunger of the hypodermic syringe is then moved proximally to draw the medication through the prior art needle and into the chamber of the syringe barrel.

The practitioner must continuously watch the plunger and the syringe barrel to ensure that the desired amount of medication is being withdrawn. Simultaneously, however, the practitioner must watch the vial to be certain that the tip of the prior art needle remains covered by the medication. As the volume of medication in the vial is depleted, the medical practitioner may have to gradually withdraw the prior art needle cannula from the vial. It will be appreciated that the last portion of medication in the vial often is difficult to extract without inadvertently separating the prior art needle from the elastomeric closure of the vial. It also will be appreciated that these final stages of withdrawing medication from a vial often coincides with filling the hypodermic syringe with the desired dose. Hence, the medical practitioner must closely observe two locations simultaneously.

After withdrawing a desired dose of medication from a vial, the medical practitioner may inject the medication into either a patient, another vial or into a Y-site fitting of an intravenous set. Also, the needle may be removed from the syringe and the luer tip of the syringe engaged into a fluid receiving device having a female luer fitting such as a stopcock. The manipulation of the needle to obtain the required dose of medication and to subsequently inject the medication creates the potential for accidental needle sticks.

Plastic vials and elastomeric closures for vials are somewhat gas permeable. Some pharmaceutical products will degrade rapidly in the presence of even small amounts of gas. Hence, these pharmaceuticals typically are stored in glass ampules. The frangible end of a glass ampule can be snapped off to enable access to the medication stored therein. The medical practitioner may withdraw the medication by inserting the tip of the needle on a hypodermic syringe into the medication stored in the ampule. The plunger of the hypodermic syringe is then moved proximally to draw the liquid medication in the ampule through the needle and into the barrel of the hypodermic syringe. The hypodermic syringe may then be withdrawn from the ampule and used in substantially the manner described above. The ampule typically is held with the open top gravitationally upwardly while the hypodermic syringe is being filled. Thus, the prior art needle used with the hypodermic syringe must have a length sufficient to reach the bottom of the ampule. This needle length required for ampule filling may exceed the length of the needle conveniently required for subsequent use for injections.

Medical practitioners encounter similar problems in attempting to fill a needle cannula from either a glass ampule or a vial with an elastomeric closure. In particular, the practitioner must carefully manipulate the small mounting hub of the prior art needle cannula while removing the prior art needle cannula from its sterile packaging and mounting the prior art needle cannula to the mounting collar of a prior art syringe barrel. The medical practitioner also must exercise considerable care throughout this procedure to avoid accidental needle sticks. Still further, the practitioner must ensure that the distal tip of the needle cannula is submerged in the fluid of the vial or ampule while simultaneously checking the level of fluid being drawn into the syringe barrel. Needles that could be more easily mounted to syringe barrels or that could facilitate filling of syringe barrels from vials or ampules would be well received by the medical profession.

SUMMARY OF THE INVENTION

The subject invention is directed to a pin assembly for accessing liquids stored in either a vial with an elastomeric seal or in an ampule. The assembly includes a vial access pin having opposed proximal and distal ends. The proximal end of the vial access pin defines a hollow hub for mounting to a hypodermic syringe. For example, the proximal end may include a pair of outwardly extending flanges that are threadedly engageable with a luer collar on a prior art hypodermic syringe.

The vial access pin may further include a flange between the distal and proximal ends and projecting outwardly to facilitate gripping of the vial access pin. The flange may include an external surface configuration to facilitate gripping and rotation.

The distal end of the vial access pin defines a cannula having a lumen extending centrally therethrough and communicating with the hollow hub at the proximal end of the vial access pin. The cannula further includes an axially extending exterior surface, which preferably is substantially cylindrical. The extreme distal tip of the cannula is sharply pointed to facilitate penetration of an elastomeric seal on the vial to be accessed by the pin but not sharp enough to accidentally pierce the user's skin. The cannula includes at least one aperture extending entirely through the cannula from the lumen to the exterior surface. The aperture may define a slot which extends proximally from the distal end of the cannula. The aperture or slot functions to permit fluid access into the cannula from locations other than the open distal tip of the cannula.

The vial access pin is used by initially securing the hollow hub of the vial access pin to a luer collar or other mounting structure on a prior art hypodermic syringe, such that the lumen through the cannula communicates with the chamber of the hypodermic syringe. The vial access pin may also be provided already assembled to a hypodermic syringe. The medical practitioner may then move the plunger of the hypodermic syringe proximally to a location corresponding to the amount of liquid that is to be withdrawn from the vial. The sharp distal end of the pin is then urged through the elastomeric seal of the vial, and the plunger is advanced in a distal direction to urge the air from the chamber of the hypodermic syringe into the vial. The medical practitioner then inverts the hypodermic syringe and the vial such that the distal tip of the vial access pin is pointing gravitationally upwardly. The plunger of the hypodermic syringe is then moved in a proximal direction to draw fluid from the vial into the chamber. Fluid entering the lumen of the vial access pin may flow through both the extreme distal tip of the cannula and through the aperture or slot. The medical practitioner observes the position of the plunger with respect to the volume measuring indicia on the syringe barrel to be certain that the desired amount of fluid is being withdrawn from the vial. The level of fluid in the vial gradually decreases as the plunger is withdrawn. Sufficient transfer of fluid from the vial to the syringe barrel may cause the extreme distal tip of the cannula to energe from the surface of the fluid. However, the aperture or slot in the cannula of the present invention ensures an uninterrupted flow of fluid to the syringe barrel, and prevents air from flowing into the syringe barrel.

The aperture or slot combines with the lumen to provide a greater cross-sectional area, and to some extent, a shorter fluid flow path, to draw fluid into the syringe thus reducing the force required to draw in the more viscous liquids.

The vial access pin is separated from the vial after a sufficient volume of fluid has been withdrawn into the syringe barrel. The medical practitioner may then use the hypodermic syringe in substantially the standard manner as explained above.

The vial access pin, as described above, is not adequate for accessing fluid in an ampule. More particularly, the aperture or slot in the cannula will prevent fluid from being drawn gravitationally upwardly from the ampule to the syringe barrel. Ampule access is enabled with the vial access pin and with an elongate tube having an inside diameter approximately equal to the outside diameter of the cannula on the vial access pin.

In use, the medical practitioner mounts the vial access pin to a hypodermic syringe in the manner described above. Preferably, this vial access pin will be provided with the elastomeric tube fitted to it. If not, the practitioner may slidably urge the separate tube over the cannula of the vial access pin a sufficient distance to cover the aperture or slot in the cannula of the vial access pin. The tube is then advanced into the ampule a sufficient distance from the distal end of the tube to be in the fluid to be withdrawn. The plunger of the hypodermic syringe is moved proximally to draw fluid from the ampule through the tube, through the cannula of the vial access pin and into the chamber of the syringe barrel.

DETAILED DESCRIPTION OF THE PREFERRED EMBODIMENT

Figure 1:
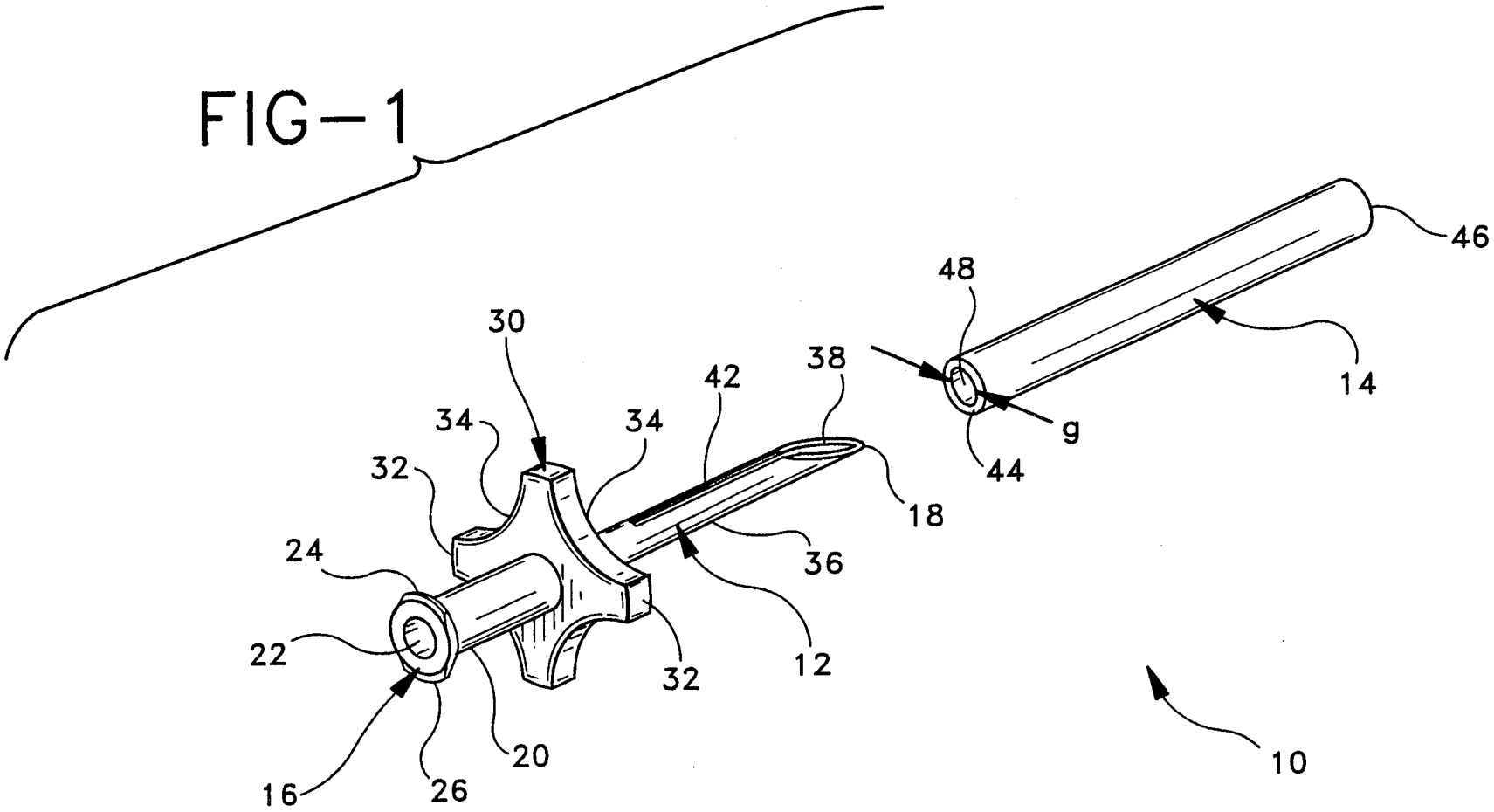
FIG. 1 is an exploded perspective view of a fluid access assembly in accordance with the subject invention.
Figure 5:
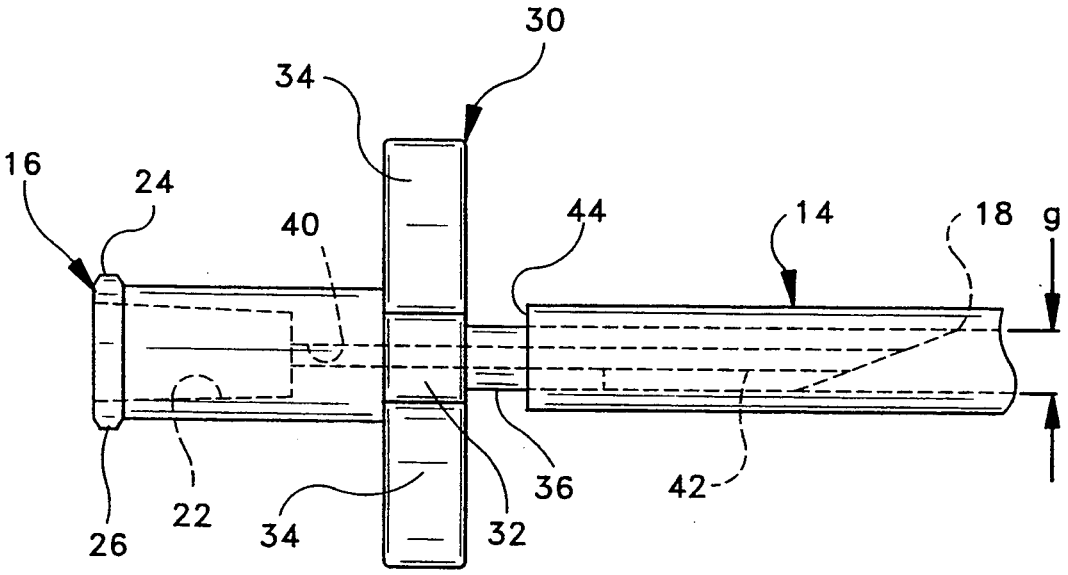
FIG. 5 is a top plan view similar to FIG. 4 but showing the ampule access tube mounted to the vial access pin.
Figure 7:
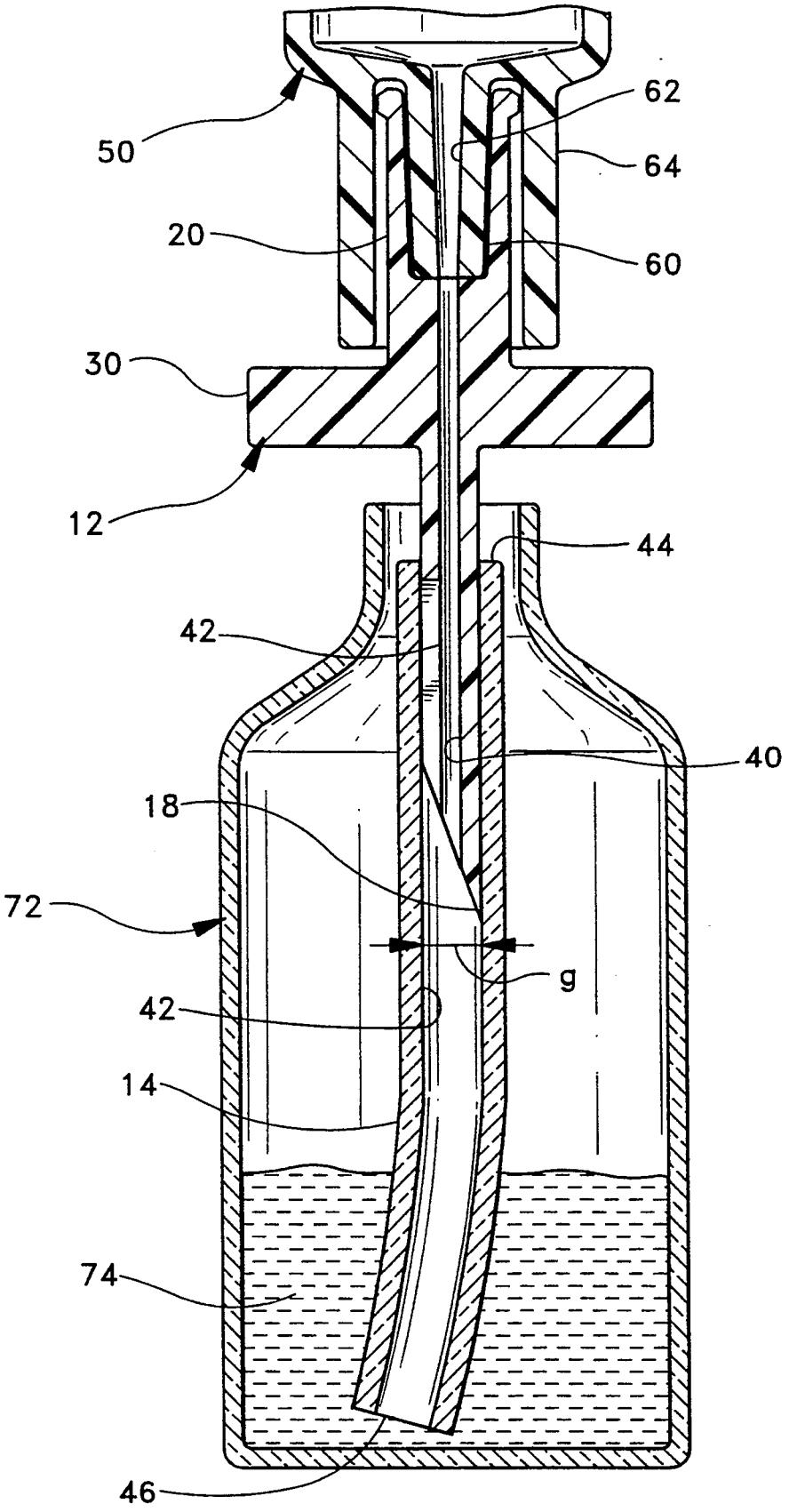
FIG. 7 is a cross-sectional view of the ampule access tube mounted on the vial access pin and disposed in an ampule.

A fluid access assembly in accordance with the subject invention is identified generally by the numeral 10 in FIGS. 1, 5 and 7. Assembly 10 includes a vial access pin 12 and an ampule access tube 14.

Vial access pin 12 is preferably molded from plastic into a unitary structure, and includes opposed proximal and distal ends 16 and 18. Portions of vial access pin 12 extending distally from proximal end 16 define a mounting hub 20. A tapered recess 22 extends distally into mounting hub 20, and is dimensioned for receiving the tip of a syringe barrel, as shown in greater detail below. Projections 24 and 26 extend radially outwardly from mounting hub 20 at proximal end 16 for threaded engagement with a locking luer type collar on a hypodermic syringe.

A flange 30 extends generally radially outwardly at a location along vial access pin 12 intermediate the opposed proximal and distal ends 16 and 18 thereof. Flange 30 includes an outer circumferential surface characterized by four circumferentially spaced convex surfaces 32 defining a major outside diameter "a" of approximately 19 mm. Concave surfaces 34 are disposed intermediate the respective spaced apart convex surfaces 32 and define minor diameters "b" on the flange 30 of approximately 13 mm. Concave surfaces 34 define portions of flange 30 that can be easily gripped and manipulated to facilitate handling of vial access pin 12, including the threaded mounting of vial access pin 12 onto hypodermic syringe or the removal of vial access pin 12 therefrom.

A cannula 36 extends from flange 30 to distal end 18 of vial access pin 12. Cannula 36 defines a cylindrical exterior with an outside diameter "c", which may be approximately 3 mm along at least a major portion of the length of cannula 36. However, portions of cannula 36 adjacent distal end 18 are tapered to define a tip 38. The sharp point defined by tip 38 enables cannula 36 to pierce through an elastomeric seal of a vial. Cannula 36 further includes an axially extending lumen 40 having an inside diameter "d" of approximately 1 mm. Lumen 40 extends entirely through cannula 36 from tip 38 and into communication with recess 22 in mounting hub 20. Thus, lumen 40 will communicate with the passage through the tip of a hypodermic syringe to which vial access pin 12 is mounted.

Cannula 36 of vial access pin 12 is further characterized by a slot 42 extending proximally from tip 38 to a location distally spaced a distance "e" from flange 30. As will be explained further herein, slot 42 ensures communication between passage 40 of cannula 36 and fluid in a vial. Thus, distance "e" between flange 30 and slot 42 may be selected in accordance with the anticipated ranges of thicknesses of elastomeric seals on vials with which the vial access pin is to be used. In a typical embodiment, the distance "e" may be approximately 6 mm. Slot 42 is spaced at a position on cannula 36 circumferentially spaced from tip 18. Thus, slot 42 will not interfere with the piercing of an elastomeric seal by tip 18 for accessing fluid in a vial. Additionally, slot 42 should not be so wide as to cause a mere slicing of the elastomeric seal or to affect the structural integrity of cannula 36. In a preferred embodiment, as illustrated most clearly in FIG. 2, slot 42 defines a width "f" which is significantly less than the inside diameter "d" of passage 40 through cannula 36. Thus, for example, embodiments of vial access pin 12 with a lumen 40 having an inside diameter "d" of 1 mm might have a slot with a width "f" of approximately 0.38 mm.

Ampule access tube 14 is preferably unitarily formed from a flexible thermoplastic material, and includes opposed proximal and distal ends 44 and 46. A through passage 48 extends axially through ampule access tube 14 and defines an inside diameter "g" which is approximately equal to the outside diameter "c" of needle cannula 36. As a result, ampule access tube 14 can be slid axially over cannula 36, and frictionally retained thereon in fluid tight engagement.

Figure 6:
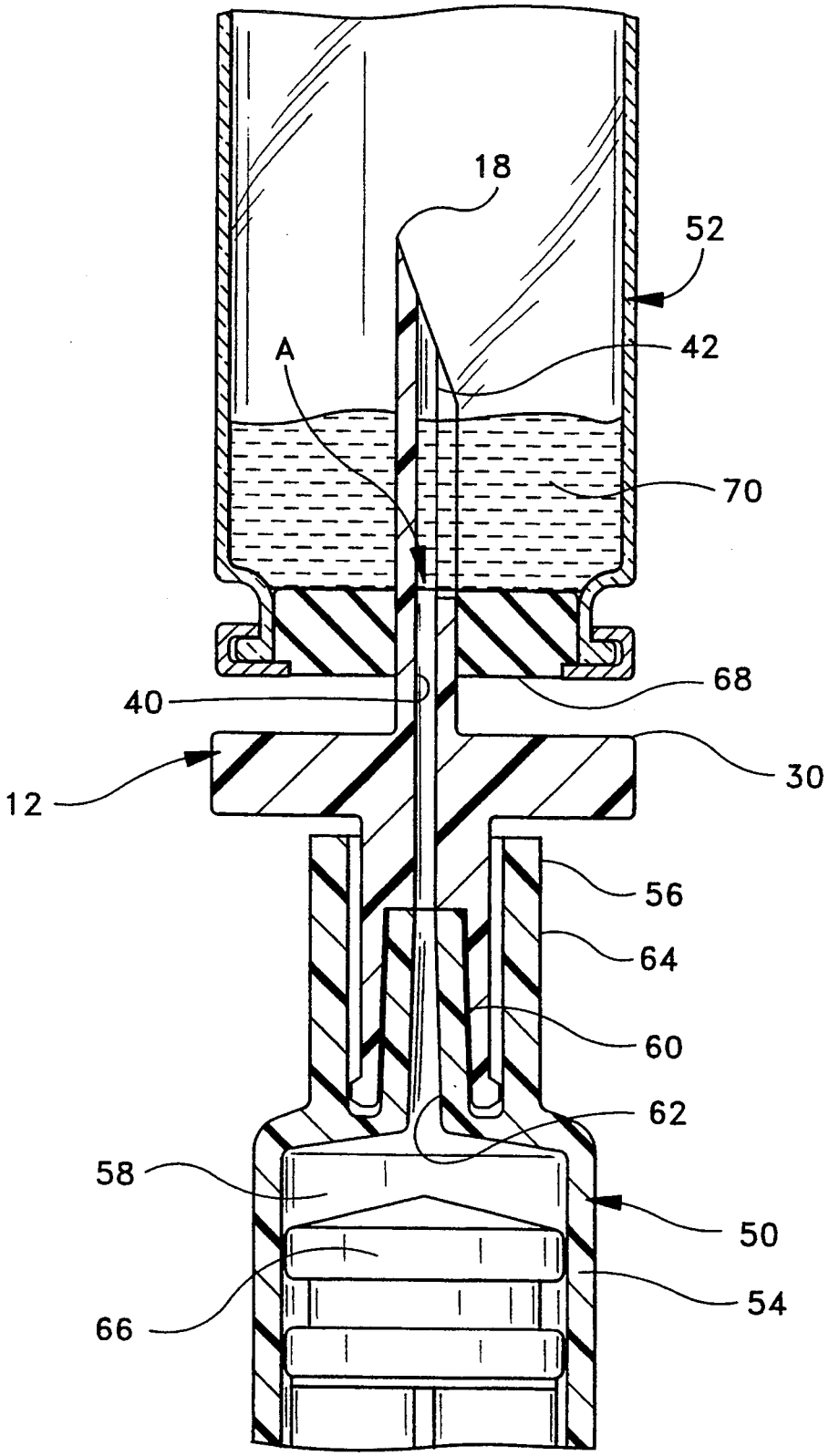
FIG. 6 is a cross-sectional view of the vial access pin used with a hypodermic syringe to access fluid in a vial.

As shown in FIG. 6, vial access pin 12 can be used with a hypodermic syringe 50 to access fluid in a vial 52. More particularly, hypodermic syringe 50 includes a syringe barrel 54 having an open proximal end (not shown), a distal end 56, and a fluid receiving chamber 58 therebetween. Distal end 56 is characterized by a tip 60 having a passage 62 extending therethrough and communicating with chamber 58 of syringe barrel 54. A locking luer-type collar 64 also extends axially at distal end 56 in spaced concentric relationship around tip 60. Luer collar 64 is characterized by an array of internal threads dimensioned for threadedly receiving projections 24 and 26 from mounting hub 20 of vial access pin 12. Syringe tip 60 is dimensioned to be axially received within recess 22 of mounting hub 20. A plunger 66 is disposed in chamber 58 in sliding fluid tight engagement with walls of syringe barrel 54. Thus, sliding movement of plunger 66 in a proximal direction draws fluid through passage 62 and into chamber 58. Conversely, sliding movement of plunger 66 in a distal direction urges fluid from chamber 58 and through passage 62.

Vial access pin 12 is used by threadedly engaging projections 24 and 26 of mounting hub 20 with the internal threads of luer collar 64. This threaded engagement can be carried out easily by grasping concave portions 34 of flange 30 with a thumb and forefinger and rotating flange 30 relative to syringe barrel 54. In its fully mounted condition, mounting hub 20 will be disposed intermediate tip 60 and luer collar 64. Additionally, passage 62 through tip 60 will be in fluid communication with lumen 40 of cannula 36 on vial access pin 12. When using syringes without locking luer collars the syringe tip will frictionally engage tapered recess 22 of mounting hub 20 to connect the vial access pin to the syringe.

Vial access pin 12 is used to access fluid in vial 52 by initially moving plunger 66 in a proximal direction to an axial position corresponding to the volume of fluid to be placed in chamber 58 of syringe barrel 54. Distal tip 18 of cannula 36 is then pierced through elastomeric seal 68 of vial 52.

Plunger 66 is then moved in a distal direction to urge a volume of air into vial 52 approximately equal to the volume of fluid to be withdrawn. Hypodermic syringe 50 and vial 52 are then inverted such that distal tip 18 of vial access pin 12 is pointing gravitationally upwardly. Plunger 66 is then moved in a proximal direction to urge fluid 70 from vial 52 through lumen 40 of cannula 36 and into chamber 58 of syringe barrel 54. The medical practitioner will compare the axial position of plunger 66 with volume measuring indicia on the cylindrical side wall of syringe barrel 54 to ensure that the desired dose is obtained. The level of fluid 70 in vial 52 will gradually decrease as fluid is drawn into chamber 58. Eventually the level of fluid 70 in vial 52 will drop to a location gravitationally beneath distal tip 18 of cannula 36 as shown in FIG. 6. However, as indicated schematically by arrows "A", slot 42 will provide continuous fluid communication between vial 52 and syringe barrel 54 and will prevent entry of air from vial 52 into chamber 58 of syringe barrel 54. As a result, the medical practitioner filling the syringe barrel 54 will not have to ensure that tip 18 remains below the surface of fluid 70 in vial 52, and all attention can be directed to measuring the dose of fluid 70 drawn into syringe barrel 58.

As noted above, an ampule does not have an elastomeric seal, and hence is not inverted during transfer fluid from an ampule to a hypodermic syringe. Vial access pin 12 could only be used with an upright ampule if the surface of fluid in the ampule was in the small space between flange 30 and slot 42 in vial access pin 12. This normally would not be the case. Access to fluid in an ampule 72 is achieved by sliding ampule access tube 14 over cannula 36 of vial access pin 12, sufficiently for slot 42 to be covered, as shown in FIGS. 5 and 7. Assembly 10 of vial access pin 12 and ampule access tube 14 is then mounted to hypodermic syringe 50 as explained above. Ampule access tube 14 is then inserted into ampule 72, such that distal end 46 thereof conveniently accesses fluid 74 in ampule 72. Plunger 66 of hypodermic syringe 50 is moved in a proximal direction, as explained above, to draw fluid through ampule access tube 14, through lumen 40 in vial access pin 12 and into syringe barrel 54. Hypodermic syringe 50 and assembly 10 can be withdrawn from ampule 72 after the required dose of fluid 74 has been drawn into syringe barrel 54. The medical practitioner may then slidably remove ampule access tube 14 from vial access pin 12 to enable vial access pin to be pierced through an elastomeric seal such as the seal on a Y-site of an I.V. set. Alternatively, the medical practitioner can separate vial access pin 12 from hypodermic syringe 50 by gripping flange 30 and rotating vial access pin 12 relative to syringe barrel 54. A different needle configuration may then be mounted to syringe barrel 54, if necessary.

Figure 2:
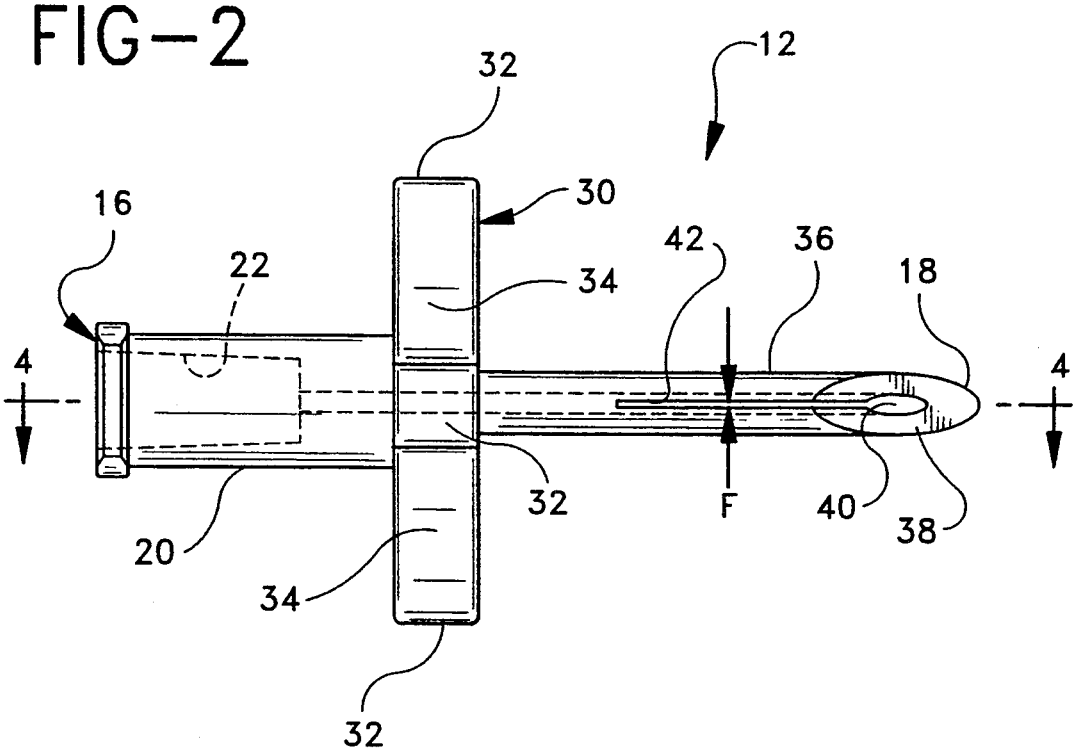
FIG. 2 is a top plan view of the vial access pin of the fluid access assembly of FIG. 1
Figure 3:
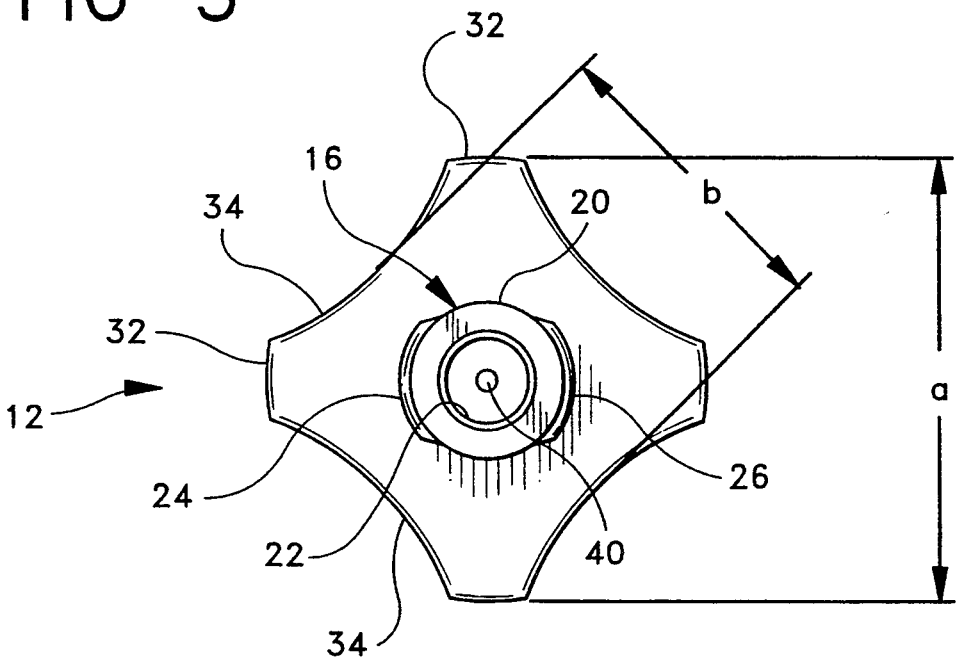
FIG. 3 is an end elevational view of the vial access pin as viewed from the left end of FIG. 2.
Figure 4:
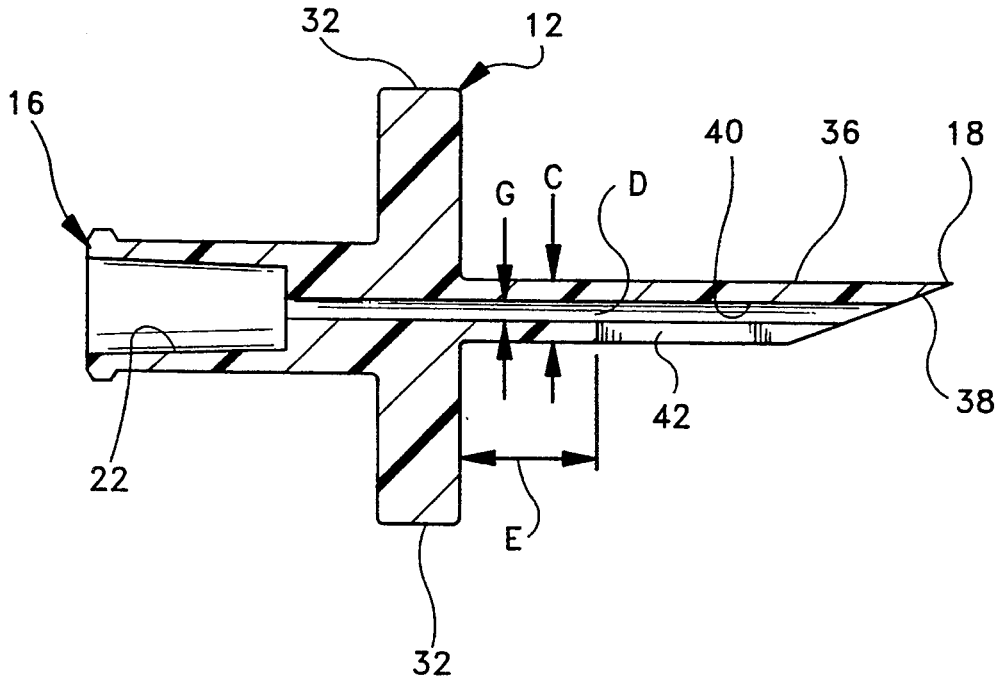
FIG. 4 is a cross-sectional view of the vial access pin of FIG. 2 taken along line 4—4.
Figure 8:
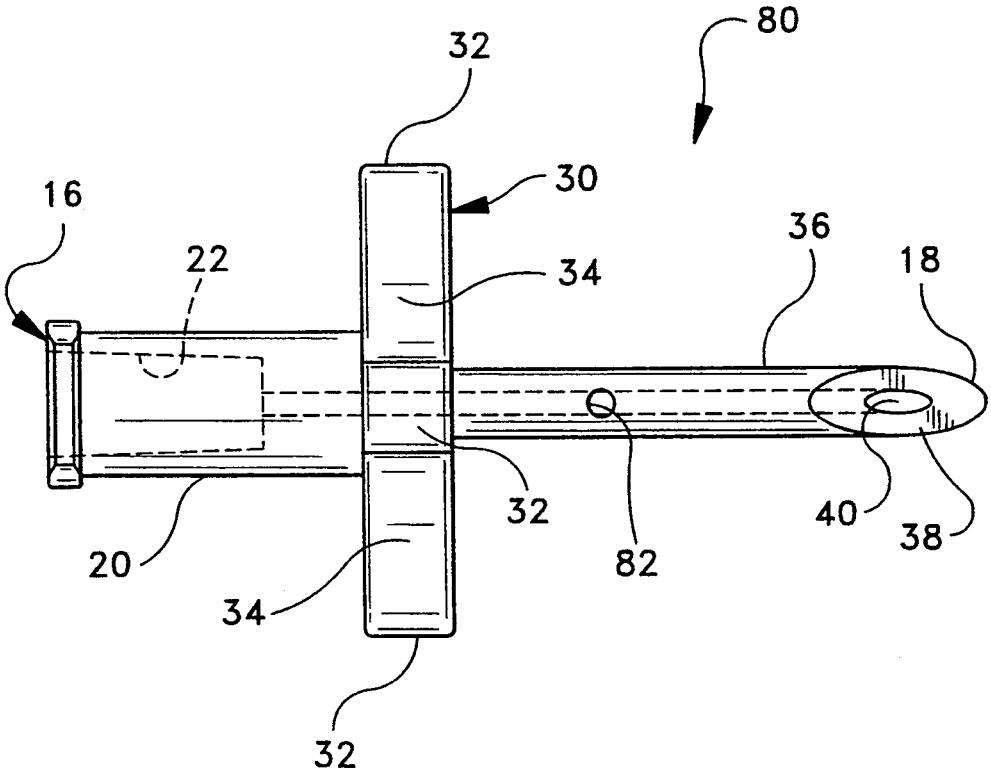
FIG. 8 is a top plan view of an alternative vial access pin, similar to the embodiment of FIG. 2, having a circularly-shaped fluid flow aperture.

FIG. 8 illustrates vial access pin 80 which is identical in all respects to vial access pin 12 illustrated in FIG. 2, except that fluid flow aperture 82, which extends through the cannula at a location disposed proximaly of the distal end, is circularly shaped. Vial access pin 80 functions the same as the vial access pin of FIG. 1–6.

What is claimed is:

1. A vial access pin for use with a hypodermic syringe to access fluid in a vial having a resilient piercable seal, comprising: an elongate body having a proximal end with mounting means for mounting said pin directly to a hypodermic syringe, a sharp distal end for piercing said seal, a cannula portion of said body extending proximally from said distal end and including a lumen extending axillay therethrough and communicating with said proximal end, a fluid flow aperture extending through said cannula at a location disposed proximally of said sharp distal end, said fluid flow aperture enabling fluid flow into said lumen from locations on said cannula proximally of said distal end, a flange extending generally radially outwardly from a location between a distal end of said mounting means and a proximal end of said fluid flow aperture, said flange having an outer circumferential configuration for facilitating engagement of said vial access pin with said hypodermic syringe, said flange extending more radially outwardly than said mounting means.

2. The vial access pin of claim 1, wherein said aperture defines a slot extending proximally from said distal end of said cannula to a location intermediate said proximal and distal ends.

3. The vial access pin of claim 1, wherein said aperture is circularly shaped and positioned intermediate said proximal and said distal ends.

4. The vial access pin of claim 2, wherein said lumen defines an inside diameter, and wherein said slot defines a width less than said inside diameter of said lumen.

5. The vial access pin of claim 2, wherein said sharp distal end defines a distal point on one longitudinal side of said cannula, said slot being disposed at a location on said cannula circumferentially spaced from said distal point.

6. The vial access pin of claim 5, wherein said slot is disposed on said cannula at a location diametrically opposite said distal tip.

7. The vial access pin of claim 1 unitarily molded from a thermoplastic material.

8. The vial access pin of claim 1 wherein said flange includes a non-circular outer circumferential configuration.

9. The vial access pin of claim 8, wherein said non-circular outer circumferential configuration of said flange includes a plurality of concave regions for facilitating gripping of said vial access pin.

10. The vial access pin of claim 1, wherein said flange is substantially planar and is aligned substantially orthogonally to the cannula.

11. A fluid access pin assembly for use with a hypodermic syringe to access fluid in a container, said assembly including a vial access pin having a proximal end with mounting means for mounting said vial access pin to said hypodermic syringe and a distal end defining a cannula, said cannula having an exterior surface, a lumen extending axially centrally through said cannula from said distal end to said proximal end, a fluid flow aperture extending through said cannula at a location proximally of said distal end, and an ampule access tube removably mounted in fluid tight engagement over said cannula and extending from a location proximally of said aperture to a location distally of said distal end of said cannula, whereby said ampule access tube enables access of fluid in an ampule and removal of said ampule access tube from said vial access pin enables access of fluid in a sealed vial.

12. The assembly of claim 11, wherein said tube is flexible.

13. The assembly of claim 11, wherein said aperture is a slot extending from said distal end of said vial access pin to a location intermediate said proximal and distal ends.

14. The assembly of claim 13, wherein said slot is narrower than said lumen through said cannula.

15. The assembly of claim 11, wherein said distal end of said pin defines a point disposed along one longitudinal side of said cannula, said slot being substantially diametrically offset from said point.

16. The assembly of claim 11, wherein said vial access pin further comprises a flange extending outwardly at a location intermediate said proximal and distal ends, said flange including a plurality of concave regions disposed radially outwardly thereon for facilitating manual gripping of said flange.

17. A method of transferring liquid from a vial having a resilient pierceable seal to a hypodermic syringe including a barrel having an open proximal end, a distal end, and a fluid-receiving chamber therebetween, said distal end including a tip having a passageway therethrough communicating with said chamber, an elongate plunger having a distal end in fluid-tight engagement within said chamber and a proximal end extending proximally outwardly from said open end of said barrel comprising the steps of:

a. providing a vial access pin including an elongate body having a proximal end, a sharp distal end of piercing said seal, a cannula portion of said body extending proximally from said distal end and including a lumen extending axillay therethrough and communicating with said proximal end, mounting means at said proximal end for mounting said pin to said tip of said hypodermic syringe, a fluid flow aperture extending through said cannula at a location disposed proximally of said distal end, said fluid flow aperture enabling fluid flow into said lumen from locations on said cannula proximally of said distal end;

b. mounting said vial access pin on said tip of said barrel of said hypodermic syringe so that said lumen is in fluid communication with said passageway;

c. aligning said vial and said vial access pin so that said sharp distal end of said pin contacts said resilient pierceable seal of said vial;

d. urging said sharp distal end of said vial access pin toward said resilient pierceable seal so that said vial access pin pierces said resilient seal and enters said vial far enough so that said fluid flow aperture is within said vial;

e. aligning the assembly of said vial access pin and said syringe into a substantially vertical orientation so that said vial is higher than said plunger;

f. moving said plunger in a proximal direction to urge liquid in said vial through said lumen of said cannula and into said chamber of said syringe barrel;

g. continue moving said plunger rod in a proximal direction until the liquid level in said vial falls below said distal end of said cannula and said fluid enters said chamber only through said fluid flow aperture; and h. continue moving said plunger in a proximal direction until the desired amount of liquid is in said chamber of said barrel.

18. The method of claim 17 wherein said aperture defines a slot extending proximally from said distal end of said cannula to a location between said proximal and distal ends of said cannula portion.

19. The method of claim 17 wherein said vial access pin includes a flange extending generally radially outwardly from a location between said distal end of said mounting means and a proximal end of said fluid flow aperture, said flange having an outer circumferential configuration for facilitating engagement of said vial access pin with said hypodermic syringe, said flange extending more radially outwardly than said mounting means.

20. The method of claim 19 wherein said fluid flow aperture includes a proximal end positioned distally from said flange a distance equal to or greater than the axial thickness of said resilient pierceable seal of said vial so that when said vial access pin pierces said resilient pierceable seal and enters the vial far enough so that said fluid flow aperture is within said vial, said flange is contacting said vial.

21. The method of claim 17 comprising the step of moving said plunger proximally in said barrel to a position corresponding to the volume of liquid to be placed in said chamber before said distal tip of said pin pierces said pierceable seal of said vial.

22. The method of claim 21 further comprising the step of moving said stopper distally in said barrel to inject the volume of air contained therein into said vial before moving said plunger proximally within said barrel to withdraw liquid from said vial into said chamber.

* * * * *